US009864392B2

(12) United States Patent
Georgiou et al.

(10) Patent No.: US 9,864,392 B2
(45) Date of Patent: Jan. 9, 2018

(54) ALL-CMOS, LOW-VOLTAGE, WIDE-TEMPERATURE RANGE, VOLTAGE REFERENCE CIRCUIT

(71) Applicants: Julius Georgiou, Nicosia (CY); Charalambos Andreou, Nicosia (CY)

(72) Inventors: Julius Georgiou, Nicosia (CY); Charalambos Andreou, Nicosia (CY)

(73) Assignee: The University of Cyprus, Nicosia (CY)

( * ) Notice: Subject to any disclaimer, the term of this patent is extended or adjusted under 35 U.S.C. 154(b) by 0 days.

(21) Appl. No.: 14/281,207

(22) Filed: May 19, 2014

(65) Prior Publication Data

US 2014/0340143 A1 Nov. 20, 2014

Related U.S. Application Data

(60) Provisional application No. 61/825,086, filed on May 19, 2013.

(51) Int. Cl.
*G05F 3/24* (2006.01)

(52) U.S. Cl.
CPC ..... *G05F 3/24* (2013.01); *G05F 3/245* (2013.01)

(58) Field of Classification Search
CPC ..... G05F 3/24; G05F 3/242; G05F 3/245
See application file for complete search history.

(56) References Cited

U.S. PATENT DOCUMENTS

| | | | | |
|---|---|---|---|---|
| 6,919,753 | B2 * | 7/2005 | Wang | G05F 3/245 327/513 |
| 7,282,901 | B2 * | 10/2007 | Pletersek | G05F 3/245 323/313 |
| 7,486,129 | B2 * | 2/2009 | Pietri | G05F 3/245 327/539 |
| 8,786,355 | B2 * | 7/2014 | Hao | G05F 3/242 323/313 |
| 2010/0045369 | A1 * | 2/2010 | Han | G05F 3/245 327/543 |

OTHER PUBLICATIONS

WIPO: "Written Opinion of the International Searching Authority"; PCT Application Serial No. PCT/IB2014/001996 (dated Jan. 26, 2015).

* cited by examiner

*Primary Examiner* — Jung Kim
(74) *Attorney, Agent, or Firm* — Bryan W. Bockhop; Bockhop Intellectual Property Law, LLC

(57) ABSTRACT

A CMOS voltage reference is disclosed. The CMOS voltage reference may include a PTAT current bias circuit including a start-up circuit, a core module implementing high order non-linear curvature compensation and an output stage supplying the reference voltage. The CMOS voltage reference may include a PTAT current bias circuit having a start-up and a CTAT feedback loop and a PTAT feedback loop and a compensating circuit summing the current from the CTAT feedback loop and the PTAT feedback loop.

6 Claims, 12 Drawing Sheets

ALL-CMOS, LOW-VOLTAGE, WIDE-TEMPERATURE RANGE, VOLTAGE REFERENCE CIRCUIT

This application claims priority to U.S. Provisional Application 61/825,086 filed on May 19, 2013, the entire disclosure of which is incorporated by reference.

BACKGROUND OF THE INVENTION

Field of the Invention

The present invention is a voltage reference. More specifically, the present invention is a complementary metal oxide semiconductor or CMOS voltage reference.

Description of the Related Art

High performance voltage references are sine qua non in a system design due to the necessity of supplying, a temperature and voltage insensitive reference to many analog, digital and mixed signal circuits such as operational amplifiers, sensors, flash memories, digital-to-analog converters or DACs, filters and regulators. The accuracy and robustness of the reference voltage will undoubtedly be of major importance if the resolution of the subsequent circuits is to have any significance in the system level. Extending the temperature range beyond commercial applications range, while sustaining similar temperature drift or TD (Temperature Drift) performance, becomes extremely challenging. Furthermore, many applications are demanding low power and low area voltage references in order to fulfill the requirements of a wide range of battery-powered, miniaturized applications.

Indeed, many recent digital and very-large-scale integration or VLSI circuits for power aware applications (portable devices, wearable medical electronics, implanted medical devices and energy harvesting systems) are designed in sub-threshold regime, requiring a consistent low voltage reference voltage for many of their subsequent circuits. Consequently, satisfying all the constraints of modern, high performance applications, is a major challenge which needs alternative and revolutionary methodologies and topologies than previously proposed ones. Conventional voltage reference designs use the temperature dependence of the bipolar transistors pn junction to create a proportional to absolute temperature or PTAT voltage, which is utilized to provide a first-order temperature compensation. These designs are limited by the base-emitter nonlinearities at a TD of approximately 20 ppm/° C., over a temperature range of approximately 100° C. Alternative proposed topologies provide high order curvature compensation by cancelling part of the nonlinear dependence of a bipolar junction transistors or BJTs base-emitter voltage, although they require complex structures with high power consumption and large area. More recent topologies utilize the temperature-dependent threshold voltage of a metal-oxide-semiconductor field-effect transistor or MOSFET and carrier mobility, to generate PTAT and complementary to absolute temperature or CTAT currents, which are summed in order to provide a first order compensated voltage. This approach has advantages on power consumption and digital process compatibility but suffers from TD performance due to higher non-linearities of MOSFETs compared to bipolar transistors.

BRIEF SUMMARY OF THE INVENTION

The present invention is a voltage reference. More specifically, the present invention is a complementary metal oxide semiconductor or CMOS voltage reference.

The CMOS voltage reference is an alternative, breakthrough voltage reference topology, which achieves high-order non-linear compensation utilizing only sub-threshold CMOS devices and two types of poly-silicon resistors such as high-ohmic p-type poly-silicon resistors and medium ohmic p-type poly-silicon resistors or high-resistivity poly-silicon resistors and low-temperature coefficient poly-silicon resistors.

The proposed voltage reference achieves superior temperature drift TD of the reference voltage with a lower supply voltage and power consumption. Two resistors in the design require trimming to overcome deviations in performance that are caused by process variations due to operating in sub-threshold and due to the variability of the resistors. The CMOS voltage reference presents an alternative voltage reference topology, which achieves high-order non-linear compensation utilizing only sub-threshold CMOS devices and two types of poly-silicon resistors (high-resistivity poly-silicon resistors and low-temperature coefficient poly-silicon resistors or high resistive poly-silicon resistors and low temperature coefficient poly-silicon resistors). The proposed voltage reference achieves high-order non-linear compensation of the reference voltage with a nominal supply voltage of 0.7V and a power consumption of 2.7 μW. The design requires trimming to overcome deviations in performance that are caused by process variations linked to sub-threshold operation and the relatively high variability of resistors.

It is an object of the present invention to provide a CMOS voltage reference that achieves high-order non-linear curvature correction utilizing only sub-threshold CMOS devices and two different types of poly-silicon resistors.

It is an object of the present invention to provide a CMOS voltage reference that utilizes a trimming methodology, where not only the slope (linear part), but also the non-linearities may be trimmed with only two resistors, which are able to trim four different cases of reference voltage deviation.

It is an object of the present invention to provide a CMOS voltage reference that compensates for the linear part as well as for the non-linear terms is performed between the transistor $MN_5$ and a pair of resistors.

It is an object of the present invention to provide a CMOS voltage reference that includes CMOS (P-type metal-oxide semiconductor or PMOS/N-type metal-oxide-semiconductor or NMOS) transistors, poly-silicon resistors (high ohmic p-type poly resistors and medium ohmic p-poly resistors) and poly capacitors.

It is an object of the present invention to provide a CMOS voltage reference that utilizes an NMOS operated in sub-threshold having positive non-linear temperature dependence along with medium resistivity poly-silicon resistors and a high-resistivity poly-silicon resistors or high resistive poly-silicon resistors and low temperature coefficient poly-silicon resistors having negative temperature dependence.

It is an object of the present invention to provide a CMOS voltage reference that transistors are operated in a sub-threshold, saturation region.

It is an object of the present invention to provide a CMOS voltage reference that values of a pair of resistors are set so as to minimize the temperature coefficient.

It is an object of the present invention to provide a CMOS voltage reference that the reference voltage is dependent from the current integrated circuits or ICs which constitutes from two currents, one through a pair of resistors and transistor $MN_5$. By selecting a proper ratio between the two currents, the topology may simply and effectively be compensated through a straightforward method so as to provide a temperature insensitive voltage at the output.

It is an object of the present invention to provide a CMOS voltage reference that utilizes the temperature-dependent threshold voltage of a MOSFET and carrier mobility, to generate PTAT and complementary to absolute temperature or CTAT currents, which are summed in order to provide a first order compensated voltage.

BRIEF DESCRIPTION OF THE DRAWINGS

The present invention will be described by way of exemplary embodiments, but not limitations, illustrated in the accompanying drawings in which like references denote similar elements, and in which.

DETAILED DESCRIPTION OF ILLUSTRATIVE EMBODIMENTS

Figure 1:
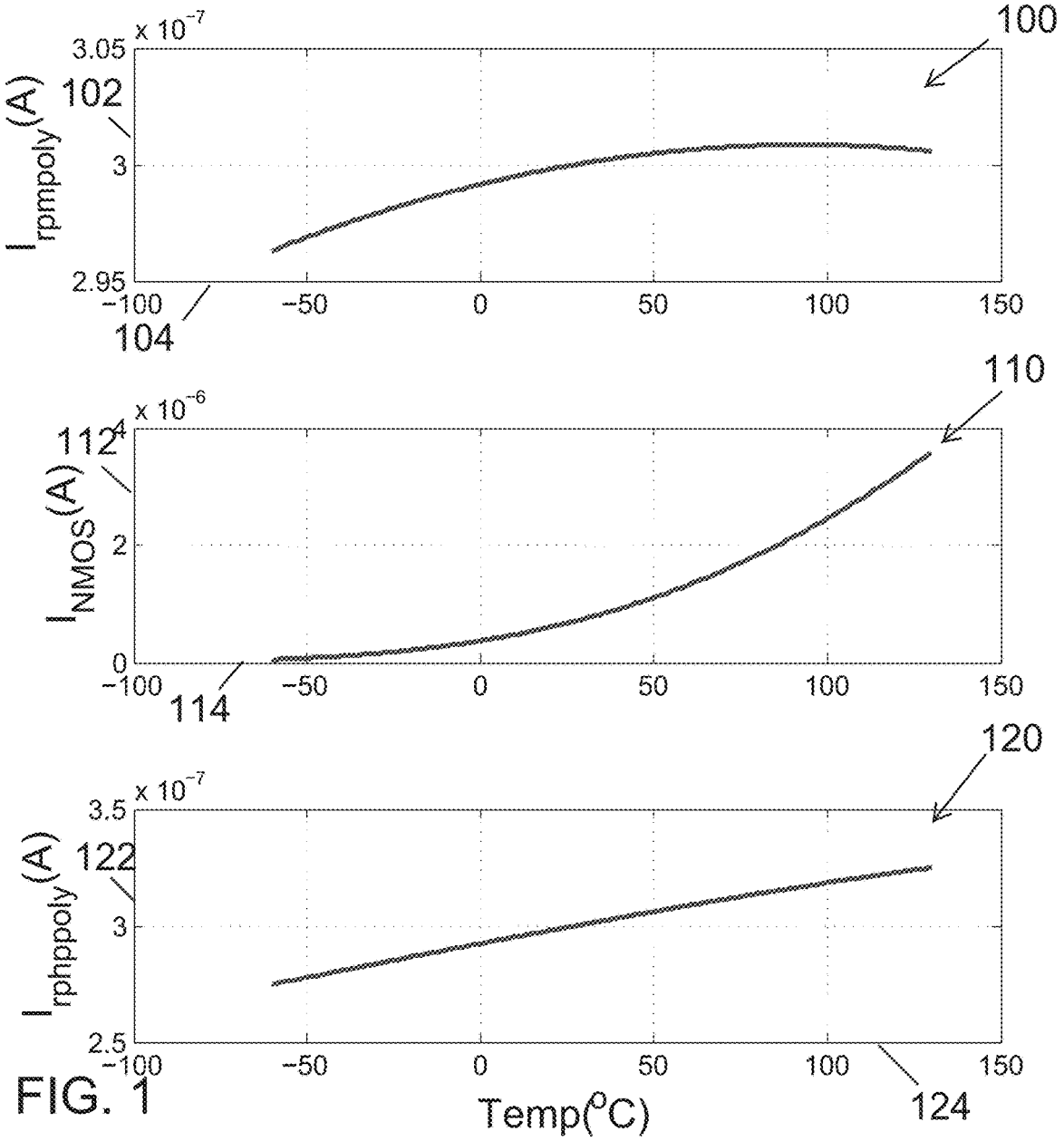
FIG. 1 illustrates a medium ohmic p-type poly-silicon resistor versus temperature graph, a sub-threshold CMOS versus temperature graph and a high ohmic p-type poly resistor versus temperature graph, in accordance with one embodiment of the present invention.

Various aspects of the illustrative embodiments will be described utilizing terms commonly employed by those skilled in the art to convey the substance of their work to others skilled in the art. However, it will be apparent to those skilled in the art that the present invention may be practiced with only some of the described aspects. For purposes of explanation, specific numbers, materials and configurations are set forth in order to provide a thorough understanding of the illustrative embodiments. However, it will be apparent to one skilled in the art that the present invention may be practiced without the specific details. In other instances, well-known features are omitted or simplified in order not to obscure the illustrative embodiments.

Various operations will be described as multiple discrete operations, in turn, in a manner that is most helpful in understanding the present invention. However, the order of description should not be construed as to imply that these operations are necessarily order dependent. In particular, these operations need not be performed in the order of presentation.

The phrase "in one embodiment" is used repeatedly. The phrase generally does not refer to the same embodiment, however, it may. The terms "comprising", "having" and "including" are synonymous, unless the context dictates otherwise.

The drain-source current in CMOS transistors, which operate in the sub-threshold region depends exponentially on the gate-source voltage and drain-source voltage:

$$I_{DS} = KI_0\exp\left(\frac{V_{GS} - V_{TH}}{nU_T}\right) \times \left(1 - \exp\left(-\frac{V_{DS}}{U_T}\right)\right)$$

where K is the transistor size aspect ratio $W_{eff}/L_{eff}$, $V_{TH}$ is the transistor threshold voltage and where $U_T=KT/q$ is the thermal voltage that is temperature dependent. $I_0$ may be described by:

$$I_0=\mu C_{ox}(n-1)U_T^2$$

where μ is the mobility of carriers in the device channel, $C_{ox}$ is the oxide capacitance per unit area and n is the sub-threshold slope factor which is expressed as:

$$n = 1 + \frac{C_d}{C_{ox}}$$

where $C_d$ is the surface depletion capacitance per unit area and is described by:

$$C_d = \sqrt{q\varepsilon_{si}\frac{N_{CH}}{2\phi_S}}$$

where q is the electron charge, εsi is the silicon permittivity, $N_{CH}$ is the doping concentration of the channel and $\varphi_S$ is the surface potential. The device is considered to be in the saturation region if the following equation is valid:

$$1 \gg \exp\left(-\frac{V_{DS}}{U_T}\right)$$

Inequality of the above equation is valid approximately when $V_{DS} \geq 4U_T$. Thus, the dependence of $I_{DS}$ in saturation becomes:

$$I_{DS} = K\mu C_{ox}(n-1)U_T^2\exp\left(\frac{V_{GS}-V_{TH}}{nU_T}\right)$$

Investigating, the drain-source current temperature dependencies are the thermal voltage, the threshold voltage and the mobility. The mobility temperature dependence is approximately expressed as:

$$\mu(T) = \mu_0\left(\frac{T}{T_0}\right)^{-m}$$

where $\mu_0$ is the mobility at room temperature $T_0$, T is the absolute temperature and m is the mobility temperature exponent which is a technology dependent constant. The threshold voltage and gate-source voltage temperature dependence may be expressed as $$V_{TH}(T) = V_{TH}(T_0) + K_T\frac{\Delta T}{T_0}$$

$$V_{GS}(T) = V_{GS}(T_0) + K_T\frac{\Delta T}{T_0}$$

where $K_T$ is a negative number between 0.5 mV/° C. and 3 mV/° C. and depends on the doping level, oxide thickness and $V_{SB}$. With increasing of temperature, the drain-source current is increased by threshold voltage and decreased by mobility. For low currents, the threshold voltage temperature dependence dominates, while for high currents the mobility temperature dependence dominates.

FIG. 1 illustrates a medium ohmic p-type poly-silicon resistor versus temperature graph 100, a sub-threshold CMOS versus temperature graph 110 and a high ohmic p-type poly resistor versus temperature graph 120, in accordance with one embodiment of the present invention.

The medium ohmic p-type poly-silicon resistor versus temperature graph 100 may have current readings on a y-axis 102 versus temperature readings in Celsius on an x-axis 104. The sub-threshold CMOS versus temperature graph 110 may have current on a y-axis 112 versus temperature readings in Celsius on an x-axis 114. The high ohmic p-type poly-silicon resistor versus temperature graph 120 may have current readings on a y-axis 122 versus temperature readings in Celsius on an x-axis 124.

Considering all the demands and limitations of modern integrated circuit or IC applications, a novel, robust and high performance voltage reference is proposed. The methodology that was utilized in order to improve the temperature drift or TD performance is illustrated in FIG. 1, where the current is plotted as a function of temperature, for a given bias voltage, corresponding to the nominal bias point in the circuit. High ohmic p-type poly resistors and medium ohmic p poly resistors with different non-linearities opposed to the ones of sub-threshold CMOS were utilized in order to achieve high order compensation of the reference voltage.

Figure 2:
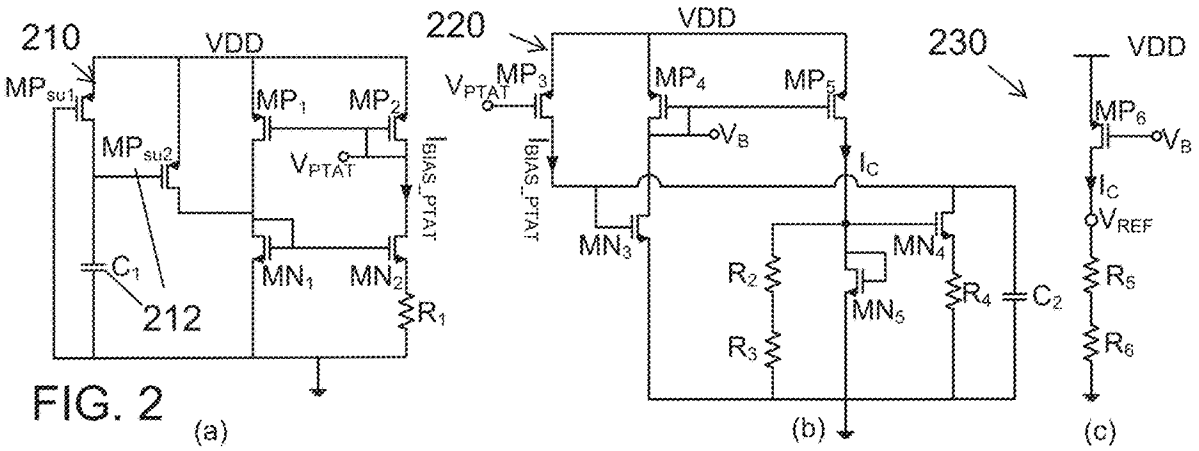
FIG. 2 illustrates an electrical schematic of a voltage reference, in accordance with one embodiment of the present invention.

FIG. 2 illustrates an electrical schematic of a voltage reference 200, in accordance with one embodiment of the present invention.

The voltage reference 200 may include a proportional to absolute temperature or PTAT circuit 210, a core module 220 and an output stage 230. The PTAT circuit 210 may be an electronic circuit transistor biasing that includes start-up circuits 212 such as $MP_{su1}$, $MP_{su2}$, $C_1$. The core module 220 may implement high-order non-linear compensation. The output stage 230 may supply any reference voltage.

The topology of the voltage reference design is illustrated in FIG. 2, where standard 0.18 μm CMOS devices were utilized, with all transistors operating in sub-threshold. The topology includes three main modules shown in FIG. 2. A PTAT circuit, including the start-up circuit ($MP_{su1}$, $MP_{su2}$, $C_1$), is shown in FIG. 2(*a*) which generates a PTAT current for supplying the module of FIG. 2(*b*). In the core module of FIG. 2(*b*), the high order non-linear compensation is performed, where $MN_4$ is biased with a PTAT current from the PTAT circuit. While temperature increases, the gate source voltage of $MN_4$ decreases, thus decreasing the voltage drop across $R_2$, $R_3$ and $MN_5$. As a result, the current flow through $R_2$, $R_3$ is decreasing while the current flow through $MN_5$ is increasing because of a simultaneous decrease of its threshold voltage. Thus the slope of the current IC is relatively compensated at a first order. The second level of compensation is performed by the use of the medium ohmic p poly resistors ($R_3$ and $R_6$), high ohmic p-type poly resistors ($R_2$ and $R_5$) and sub-threshold CMOS ($MN_4$ and $MN_5$). The use of these specific devices exploits their complimentary non-linear responses over temperature. As a result, a mutually compensated reference voltage is achieved, were both, the slope as well as the non-linearities are compensated over temperature. The final compensated current is mirrored in the output module of FIG. 2(*c*) where we get the reference voltage.

The reference voltage is dependent from the current IC which constitutes from two currents, one through the resistors $R_2$, $R_3$ and the one through the transistor $MN_5$. By selecting a proper ratio between the two currents, the topology may simply and effectively compensated through a straightforward method so as to provide a temperature insensitive voltage at the output. The reference voltage at the output of the proposed topology in FIG. 2 may be expressed as $$V_{REF}=I_C\times R_{5,6}$$

where $R_{x,y}=R_x+R_y$ and the current IC consists of the currents through resistors $R_2$ and $R_3$, and the current through the transistor $MN_5$ as:

$$I_C=I_{R2,3}+I_{MN5}$$

and may be expanded in the form of:

$$I_C = \frac{V_{GS4} + I_{B_PTAT}\times R_4}{R_{2,3}} + K_{MN5}I_0\exp\left(\frac{V_{GS5}-V_{TH}}{nU_T}\right)$$

applying some recalculations in, it may be rewritten as:

$$I_C = \frac{V_{GS4}}{R_{2,3}} + \frac{R_4}{R_{2,3}}I_{B_PTAT} + K_{MN5}I_0\exp\left(\frac{V_{GS5}-V_{TH}}{nU_T}\right)$$

The current through a PTAT circuit may be expressed by:

$$I_{PTAT} = \frac{U_T}{R_1} + \frac{K_{MP3}}{K_{MP2}} \ln\left(\frac{K_{MP2} \times K_{MN2}}{K_{MP1} \times K_{MN1}}\right)$$

Where for this topology as shown in Table I the ratios:

$$\frac{KMP_3}{KMP_2} = 1$$

and $$\frac{KMP_2}{KMP_1} = 1$$

Substituting into, the current IC becomes of the form:

$$I_C = \frac{V_{GS4}}{R_{2,3}} + \frac{R_4}{R_{2,3}} \frac{U_T}{R_1} \ln\left(\frac{K_{MN2}}{K_{MN1}}\right) + K_{MN5} I_0 \exp\left(\frac{\frac{U_T R_4}{R_1} \ln\left(\frac{K_{MN2}}{K_{MN1}}\right) + V_{GS4} - V_{TH}}{nU_T}\right)$$

TABLE I

Circuit Elements Dimensions of the Proposed Voltage Reference Architecture

| Component | Parameter |
|---|---|
| $MP_{su1}$ | W = 3 μm, L = 10 μm |
| $MP_{su2}$ | W = 2 μm, L = 10 μm |
| $MP_1$, $MP_2$, $MP_3$ | W = 12 μm, L = 4 μm |
| $MR_4$, $MP_5$, $MP_6$ | W = 20 μm, L = 4 μm |
| $MN_1$ | W = 15 μm, L = 4 μm |
| $MN_2$ | W = 300 μm, L = 4 μm |
| $MN_3$ | W = 8 μm, L = 8 μm |
| $MN_4$ | W = 100 μm, L = 4 μm |
| $MN_5$ | W = 40 μm, L = 4 μm |
| $R_1$ (rpmpoly) | 330 KΩ |
| $R_2$ (rphpoly), $R_3$ (rpmpoly) | 500 KΩ |
| $R_4$ (rphpoly) | 220 KΩ |
| $R_5$ (rphpoly) | 157.5 KΩ |
| $R_6$ (rpmpoly) | 130 KΩ |
| $C_1$ | 2 pF |
| $C_2$ | 3 pF |

Therefore by substituting the IC, the reference voltage becomes $$V_{REF} = \underbrace{\frac{V_{GS4} R_{5,6}}{R_{2,3}}}_{\alpha} + \underbrace{\frac{R_4 R_{5,6}}{R_1 R_{2,3}} \times U_T \ln\left(\frac{K_{MN2}}{K_{MN1}}\right)}_{\beta} + \underbrace{R_{5,6} K_{MN5} I_0 \exp\left(\frac{V_{GS5} - V_{TH}}{nU_T}\right)}_{\gamma}$$

It may be deduced that the resistors of the segments α and β are cancelling out between their numerator and denominator, thus the process variations of the resistors are not affecting the reference voltage slope. The resistors process variations are only affecting the non-linear part of the segment, where R5, 6 are remaining. Finally, replacing $V_{GS5}$ with $(I_{PTAT} \times R_4 + V_{GS4}$ a detailed equation of the output reference voltage of the proposed topology is obtained without considering the temperature dependence:

$$V_{REF} = \underbrace{\frac{V_{GS4} R_{5,6}}{R_{2,3}}}_{\gamma} + \underbrace{\frac{R_4 R_{5,6}}{R_1 R_{2,3}} \times U_T \ln\left(\frac{K_{MN2}}{K_{MN1}}\right)}_{\delta} + \underbrace{R_{5,6} K_{MN5} I_0 \exp\left(\frac{V_{GS5} - V_{TH}}{nU_T}\right)}_{\epsilon}$$

At this point we may incorporate the temperature dependence of the transistors and resistors in order to tackle into the high order non-linear compensation which is the eliciting factor that limits the performance of the state of the art voltage references. The temperature dependence of the polysilicon resistors that are utilized in the proposed topology is expressed by:

$$R_x(T) = R_x(T_0)(1 + \alpha\Delta T + \beta\Delta T^2)$$

where α and β are technology dependent constants.

After some calculations:

$$V_{REF} = \underbrace{\frac{\frac{\alpha_1}{V_{GS4}(T_0) R_{5,6}(T_0)}}{R_{2,3}(T_0)} + K_T \frac{\frac{\alpha_2}{R_{5,6}(T_0)}}{T_0 R_{2,3}(T_0)} \Delta T}_{\alpha} + \underbrace{\frac{R_4(T_0) R_{5,5}(T_0)}{R_1(T_0) R_{2,5}(T_0)} \times \frac{K}{q} \ln\left(\frac{K_{MN2}}{K_{MN1}}\right) T}_{\beta} +$$

$$\underbrace{R_{5,6}(T_0)(1 + \alpha\Delta T + \beta\Delta T^2) K_{MN5} C_{ox}(n-1)\mu_0 \times \left(\frac{T}{T_0}\right)^{-1.5} \left(\frac{KT}{q}\right)^2 \exp\left(\frac{V_{GS5}(T_0) + K_T \frac{\Delta T}{T_0} - V_{TH}}{n\frac{KT}{q}}\right)}_{\gamma}$$

Applying and doing a few recalculations:

$$\alpha = \alpha_1 + \alpha_2 dT \Rightarrow \frac{d\alpha}{dT} = \alpha_2 \rightarrow \text{constant}$$

$$\frac{d(\beta T)}{dT} = \beta \rightarrow \text{constant}$$

$$\frac{d\gamma}{dT} = \delta\sqrt{T}\, e^{f(\tau)}$$

After extracting the temperature dependence of the proposed topology it is perceived that the nonlinear compensation is performed from segment γ, which includes a second order non-linear compensation multiplied with an exponential compensation. The combination of two complementary high-order non-linear compensations, multiplied across temperature, results in a higher order nonlinear compensation which leads to a superior temperature compensation over a wider temperature range. The resistors ratios are tuning the slope as well as the non-linearities of the reference voltage. By proper sizing of the resistance ratios, the optimum TD of the reference voltage may be achieved.

While operating in sub-threshold region, process variations may affect the performance of the fabricated chips, thus resistor trimming will ensure that the simulated performance will approximately match the measured results. In this invention we propose a new trimming methodology which has essential advantages compared to prior-art. The developed trimming method is very simple and effective with minimum effort and time costs. The impact of resistors $R_2$ and $R_4$ to the reference voltage slope and non-linearities, as well as their tunability range, imposes that these resistors are the chosen ones for post-layout fine tuning and post-fabrication trimming. Thus, resistors $R_2$ and $R_4$ are designed to be trimmed, each with 3-bits of trimming.

Figure 3:
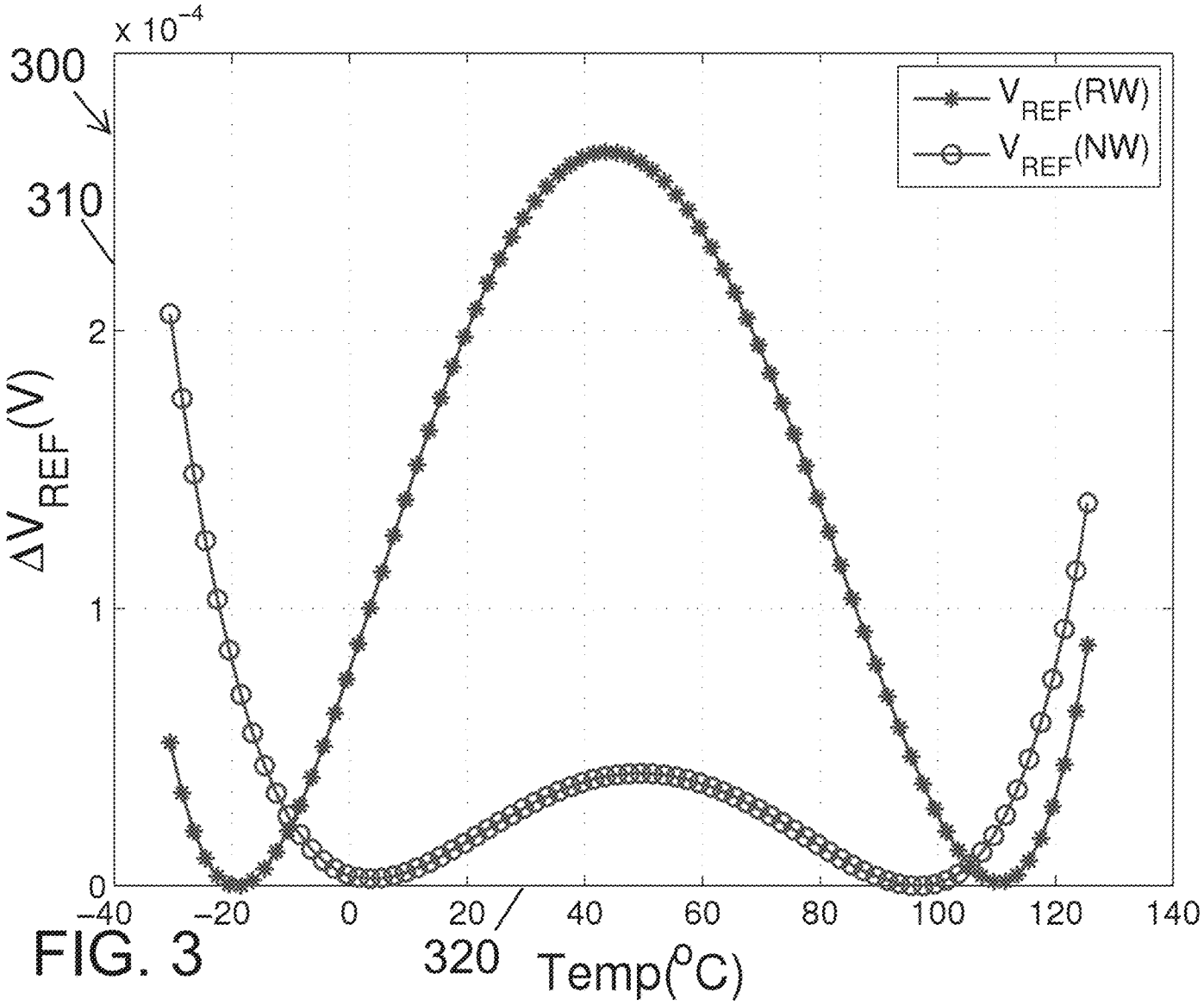
FIG. 3 illustrates a graph of a plurality of deviations of the non-linearities influencing the TD of a reference voltage, in accordance with one embodiment of the present invention.

FIG. 3 illustrates a graph 300 of a plurality of deviations of the non-linearities influencing the TD of a reference voltage, in accordance with one embodiment of the present invention.

The graph 300 may include the deviations of the non-linearities on the y-axis 310 versus temperature readings in Celsius on an x-axis 320.

The simplicity and effectiveness of the proposed trimming method is based on the fact that two resistors are able to trim four different cases of the reference voltage deviations. This is clearly demonstrated in FIG. 3 where all the cases of the reference voltage deviations are simulated, discriminated and demonstrated to over temperature.

Figure 4:
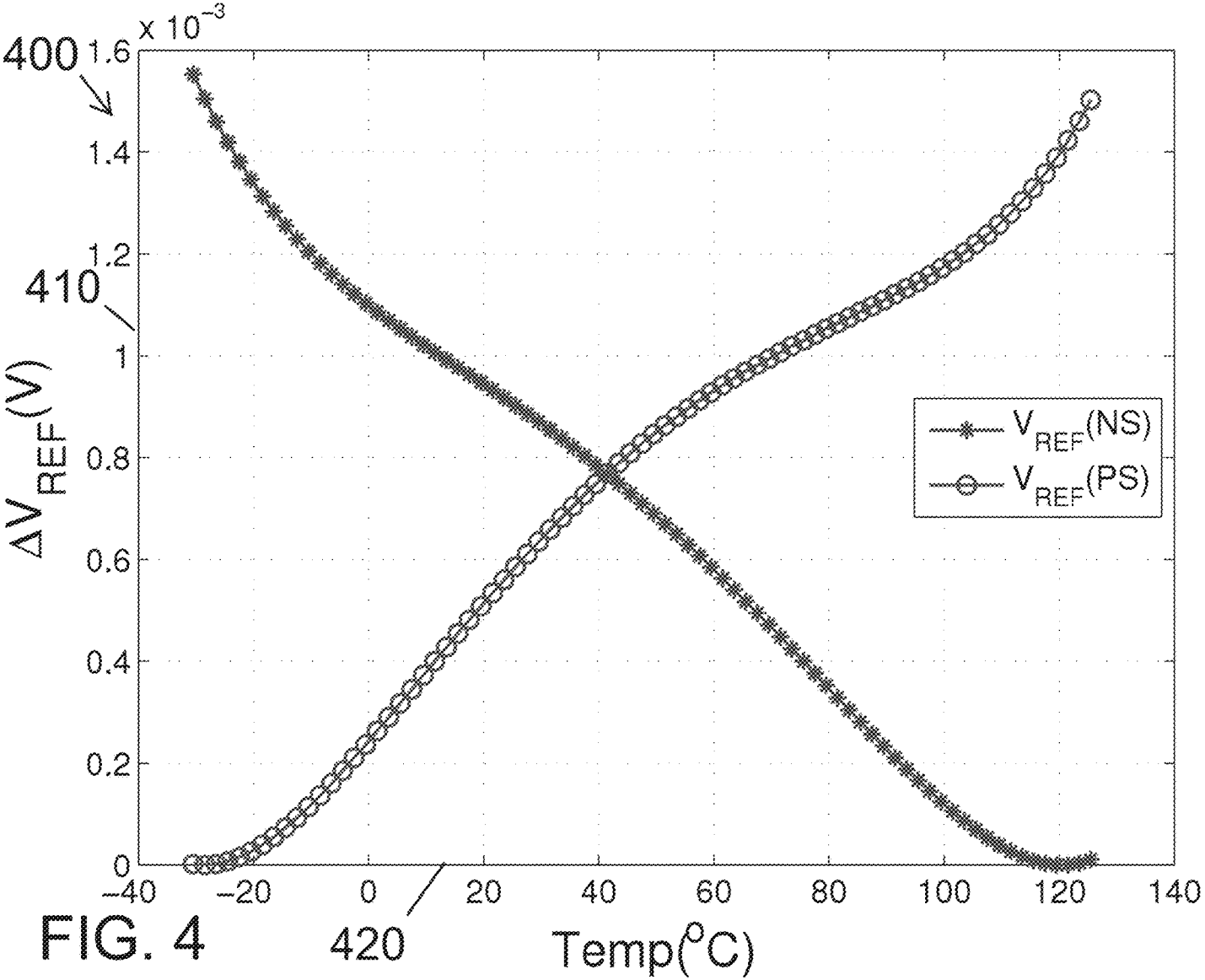
FIG. 4 illustrates a graph of a plurality of deviations of the slope influencing the TD of the reference voltage, in accordance with one embodiment of the present invention.

FIG. 4 illustrates a graph 400 of a plurality of deviations of the slope influencing the TD of the reference voltage, in accordance with one embodiment of the present invention.

The graph 400 may include the deviations of the slope (linear component on the y-axis 410 versus temperature readings in Celsius on an x-axis 420.

In FIG. 3 the deviations of the reference voltage non-linearities are illustrated, while the slope compensation is optimum. Where $V_{REF}$ (RW) indicates that $R_2$ and $R_3$ poly-si resistors non-linearities are dominating the ones of $MN_4$ and $MN_5$ transistors, and where $V_{REF}$ (NW) indicates that $MN_4$ and $MN_5$ transistor non-linearities are dominating the ones of $R_2$ and $R_3$. In FIG. 4 the deviations of the reference voltage slope are illustrated, whereas the non-linearities compensation is optimum. $V_{REF}$ (PS) indicates that the current drawn by the $MN_5$ transistor is dominating the one drawn by $R_2$ and $R_3$, while $V_{REF}$ (NS) indicates that the current drawn by the resistors $R_2$ and $R_3$ is dominating the one drawn by $MN_5$. The reasoning behind this strategy is that $R_2$ and $R_3$ are tuning the influence of the resistors on IC slope and non-linearities while $R_4$ is acting as source degeneration of $MN_4$, tuning the influence of sub-threshold transistor $MN_4$ on the IC slope and non-linearities.

TABLE II

STRATEGY FOR POST-LAYOUT TUNING & POST-FABRICATED TRIMMING

| Case | Correction Strategy |
|---|---|
| VREF_NW | $R_2 \downarrow$ & $R_4 \uparrow$ |
| VREF_RW | $R_2 \uparrow$ & $R_4 \downarrow$ |
| VREF_NS | $R_2 \uparrow$ & $R_4 \uparrow$ |
| VREF_PS | $R_2 \downarrow$ & $R_4 \downarrow$ |

A clear and detailed strategy of trimming is shown in Table II. With $2^2$ combinations of the two resistors, all four possible worst case discriminated scenarios have a simple counter measure for optimizing the performance. Another very important advantage of the proposed trimming method is that the TD performance may be trimmed over the whole temperature range at a single point, which makes it trivial, saving time and costs. Applying a full temperature sweep on the reference circuit, identifying the case of deviation from FIGS. 3 and 4 and following the straightforward indications of Table II is leading to a trivial compensation of any deviation of the reference voltage. The proposed trimming method is not dedicated only for the proposed voltage reference topology, as it may be expanded and utilized in a wide range of voltage references and BGRs circuits that use CMOS devices and resistors for compensating the reference voltage.

Figure 5:
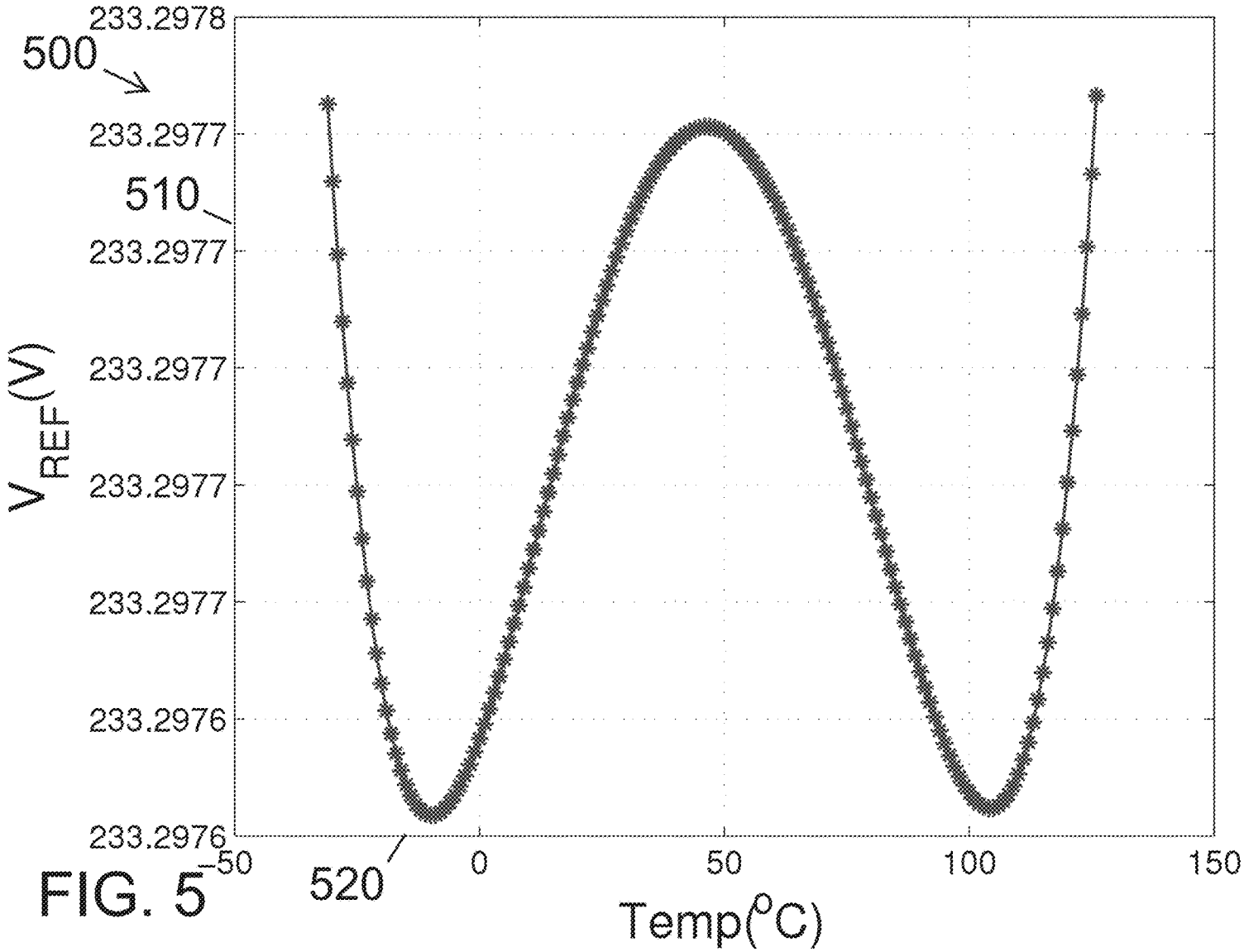
FIG. 5 illustrates a graph of simulated TD of a voltage reference output, in accordance with one embodiment of the present invention.

FIG. 5 illustrates a graph 500 of simulated TD of a voltage reference output, in accordance with one embodiment of the present invention.

The graph 500 may include the output reference voltage on the y-axis 510 versus temperature readings in Celsius on an x-axis 520.

The reference voltage of the topology of FIG. 2 was simulated utilizing CMOS 0.18 μm technology. The results across temperature corners are presented in FIG. 5 where the TD is 2.4 ppm/° C. with a bias of 0.7V. The simulated results show an improved non-linear compensation over a wider temperature range. The proposed voltage reference of FIG. 2 was fabricated at Tower Jazz foundry, in CMOS 0.18 μm semi-conductors technology with the devices sized as shown in Table I. Nine fabricated chips from two different wafers were extensively measured and characterized. The measurements were performed with a Keithley 4200 Semiconductor Characterization System and an Espec SU-261 Temperature Chamber.

TABLE III

MEASURED TD OF 9 SAMPLES WITH BIAS VOLTAGE OF 0.7 V FOR A TEMPERATURE RANGE OF 185° C. (−60° C. TO 125° C.)

| Sample | TD ppm/° C. |
|---|---|
| 1 | 11 |
| 2 | 14.5 |
| 3 | 15.7 |
| 4 | 12.8 |
| 5 | 17.2 |
| 6 | 9.9 |
| 7 | 19.4 |

TABLE III-continued

| MEASURED TD OF 9 SAMPLES WITH BIAS VOLTAGE OF 0.7 V FOR A TEMPERATURE RANGE OF 185° C. (−60° C. TO 125° C.) | |
|---|---|
| Sample | TD ppm/° C. |
| 8 | 10.7 |
| 9 | 9.3 |

The measured post-trimmed TD of the nice chips with a supply voltage of 0.7V is presented in Table III where the TD is between 9.3 ppm/° C. and 19.4 ppm/° C. The topology may operate reliable for a wide range of bias voltages that are between 0.6V-1.8V.

Figure 6:
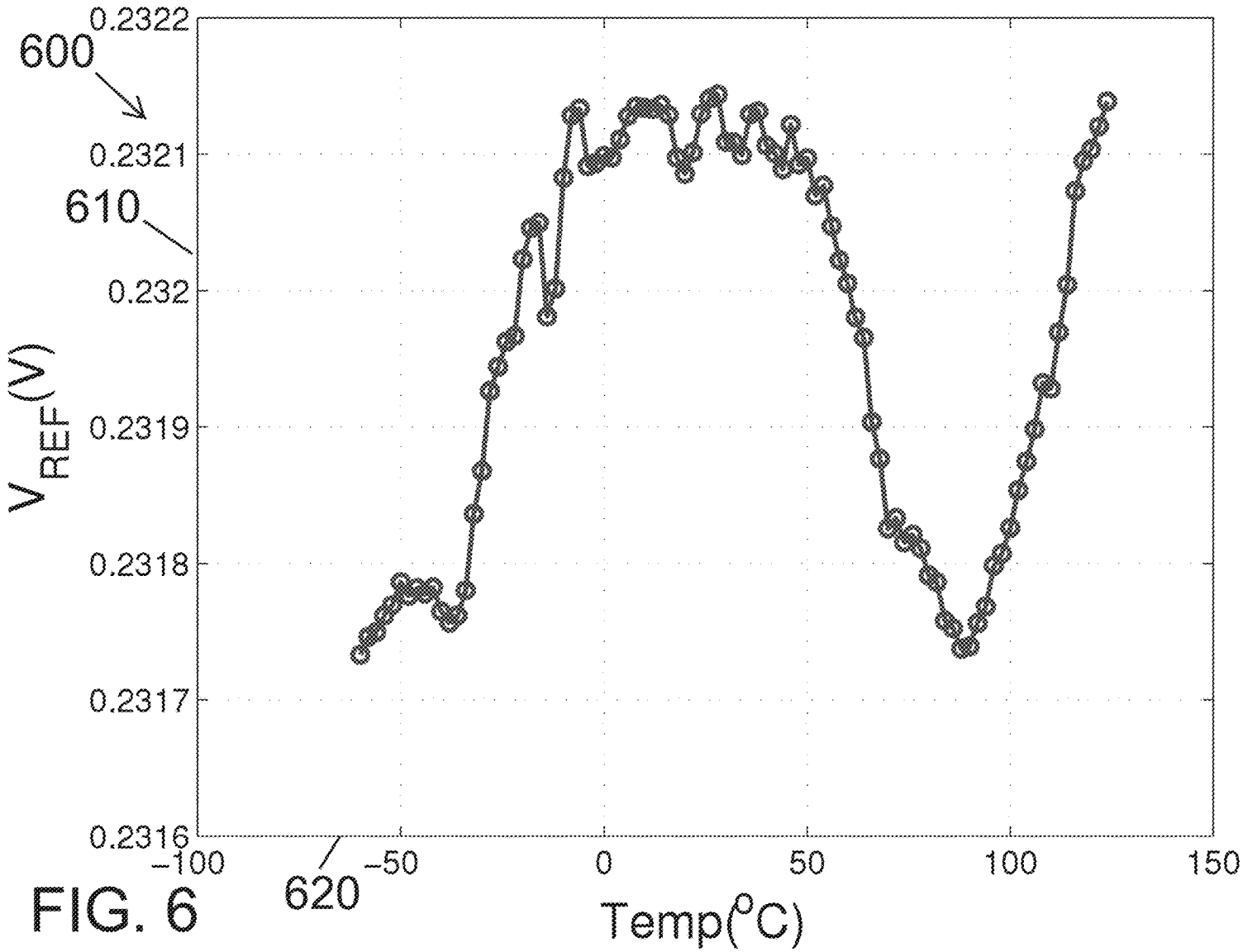
FIG. 6 illustrates a graph of measured TD of a voltage reference output biased at 0.7V, in accordance with one embodiment of the present invention.

FIG. 6 illustrates a graph 600 of measured TD of a voltage reference output biased at 0.7V, in accordance with one embodiment of the present invention.

The graph 600 may include measured output reference voltage on the y-axis 610 versus temperature readings in Celsius on an x-axis 620.

The TD was measured utilizing the box-method and is presented in FIG. 6, where the proposed voltage reference achieves a TD of 9.3 ppm/° C. over a wide temperature range of 185° C. (−60° C. to 125° C.) with a bias voltage of 0.7V. The proposed trimming method allows for even better TD performance than 9.3 ppm/° C., in the expense of narrowing the temperature range if that is necessary by the application.

Figure 7:
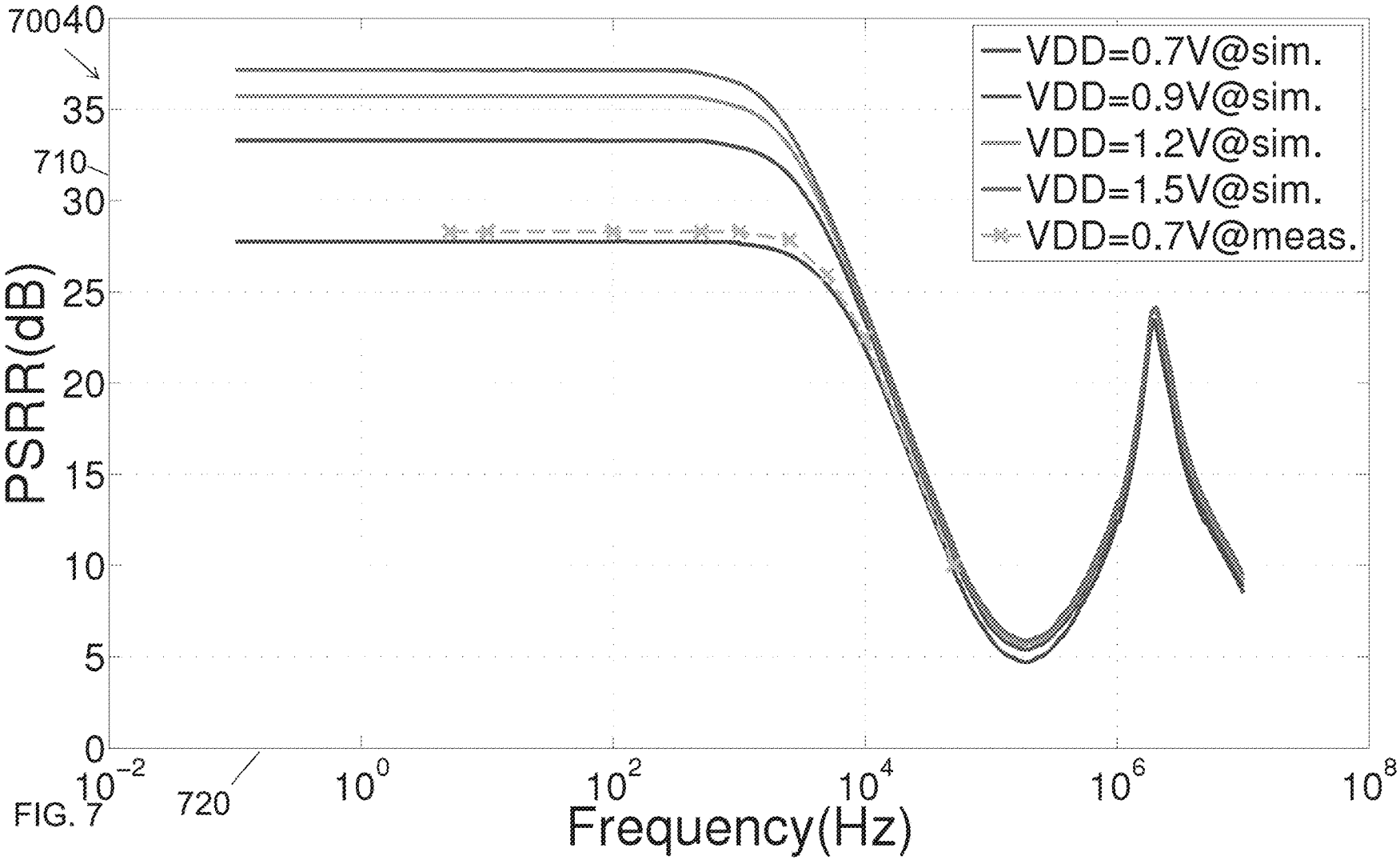
FIG. 7 illustrates a graph of a measured and simulated PSRR of the proposed topology with different biased voltages at 27° C., in accordance with one embodiment of the present invention.

FIG. 7 illustrates a graph 700 of a measured and simulated PSRR of the proposed topology with different biased voltages at 27° C., in accordance with one embodiment of the present invention.

The graph 700 may include the PSRR in decibels on a y-axis 710 and the Frequency in Hertz on the x-axis 720.

The measured and simulated power supply rejection ratio or PSRR at 27° C. is presented in FIG. 7 and it's around 28 dB for bias voltage of 0.7V and it increases for higher supply voltages. Although PSRR is inferior compared to some of the prior-art designs, it may be significantly improved at the system level by stacking a relatively big transistor at top of all the sub-threshold topologies. This will substantially improve the PSRR with a minor increase of the supply voltage.

Figure 8:
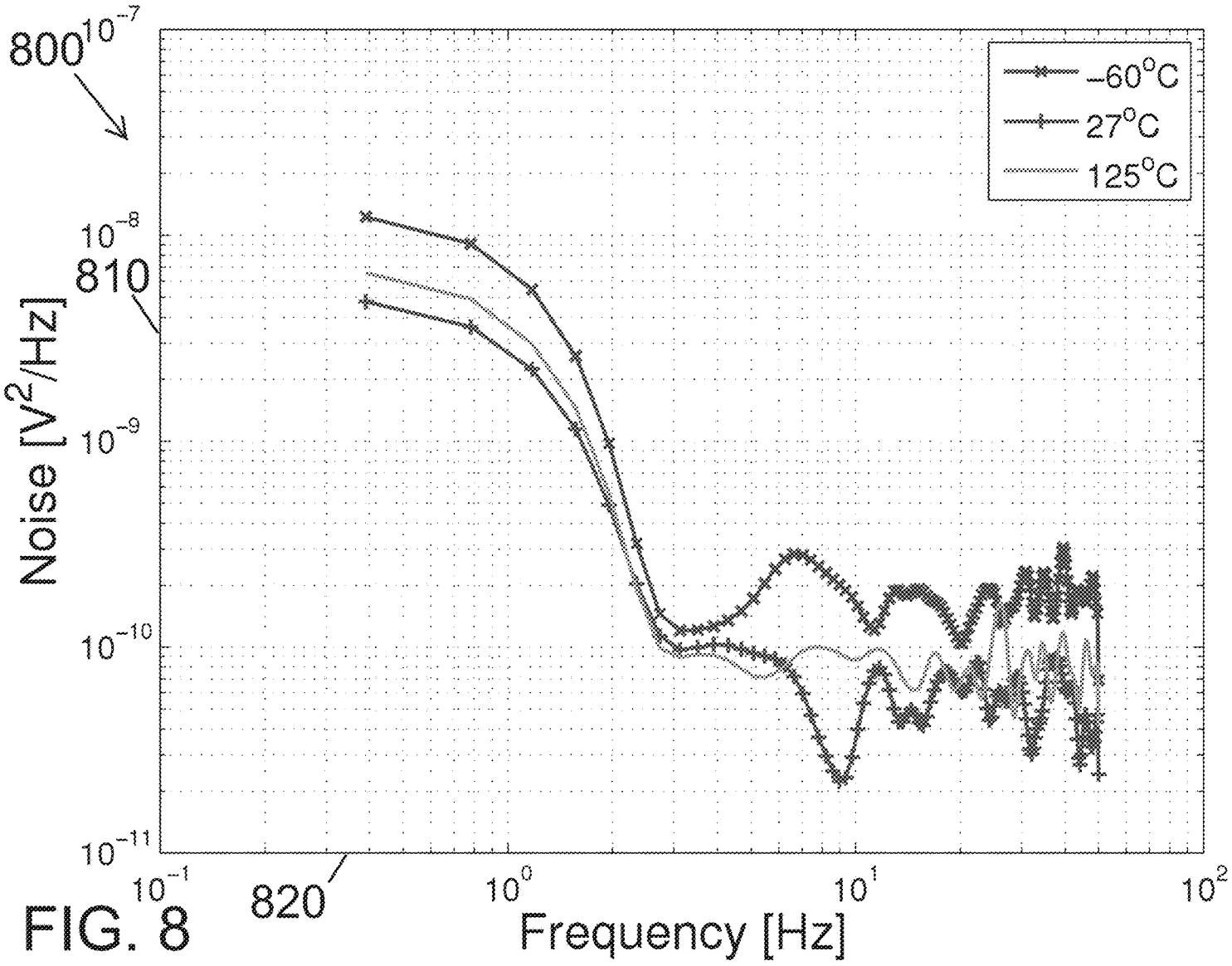
FIG. 8 illustrates a graph of a measured noise spectrum of the proposed topology biased at 0.7V for −60° C., 27° C. and 125° C., in accordance with one embodiment of the present invention.

FIG. 8 illustrates a graph 800 of a measured noise spectrum of the proposed topology biased at 0.7V for −60° C., 27° C. and 125° C., in accordance with one embodiment of the present invention.

The graph 800 may include a noise reading 810 on a y-axis and the Frequency in Hertz on the x-axis 820.

The measured noise spectrum at room temperature as well as in the extreme temperature corners without filtering capacitors is presented in FIG. 8. The total root mean square voltage noise measured at the output between 0.1 Hz and 50 Hz is 59 μV without any external capacitors. Thus the total noise is well below the TD performance of the reference voltage. Although not necessary, the addition of a load capacitor at the output would further improve the noise value. The power consumption at room temperature with a bias of 0.7V is 2.7 μW and the minimum supply voltage for the topology is 0.6V. The topology does not face any start-up problems under any bias conditions while utilizing slow and fast ramps at the supply during simulations as well as during measurements.

A breakthrough, ultra-low power, low voltage, all-CMOS voltage reference topology is presented. The proposed circuit is simple to design and demonstrates the feasibility of designing circuits in sub-threshold for power aware applications while maintaining a competitive performance for a wide temperature range. The accuracy of TD is maintained even in the very low temperature of −60° C. where no other prior art designs are performing up to date. The eliciting factor of limiting the TD performance of prior-art voltage references (non-linearities) was eliminated with a straightforward and effective way. The fully CMOS design without any external capacitors increase the integration and minimizes the cost and size of the IC. The novel and effective trimming method that was proposed may compensate the reference voltage slope and non-linearities variations due to operating in sub-threshold region. The proposed voltage reference is suitable for low power, low area and high accuracy biomedical applications, mobile devices, energy harvesting systems and space applications that may operate reliably in extreme temperatures.

Figure 9:
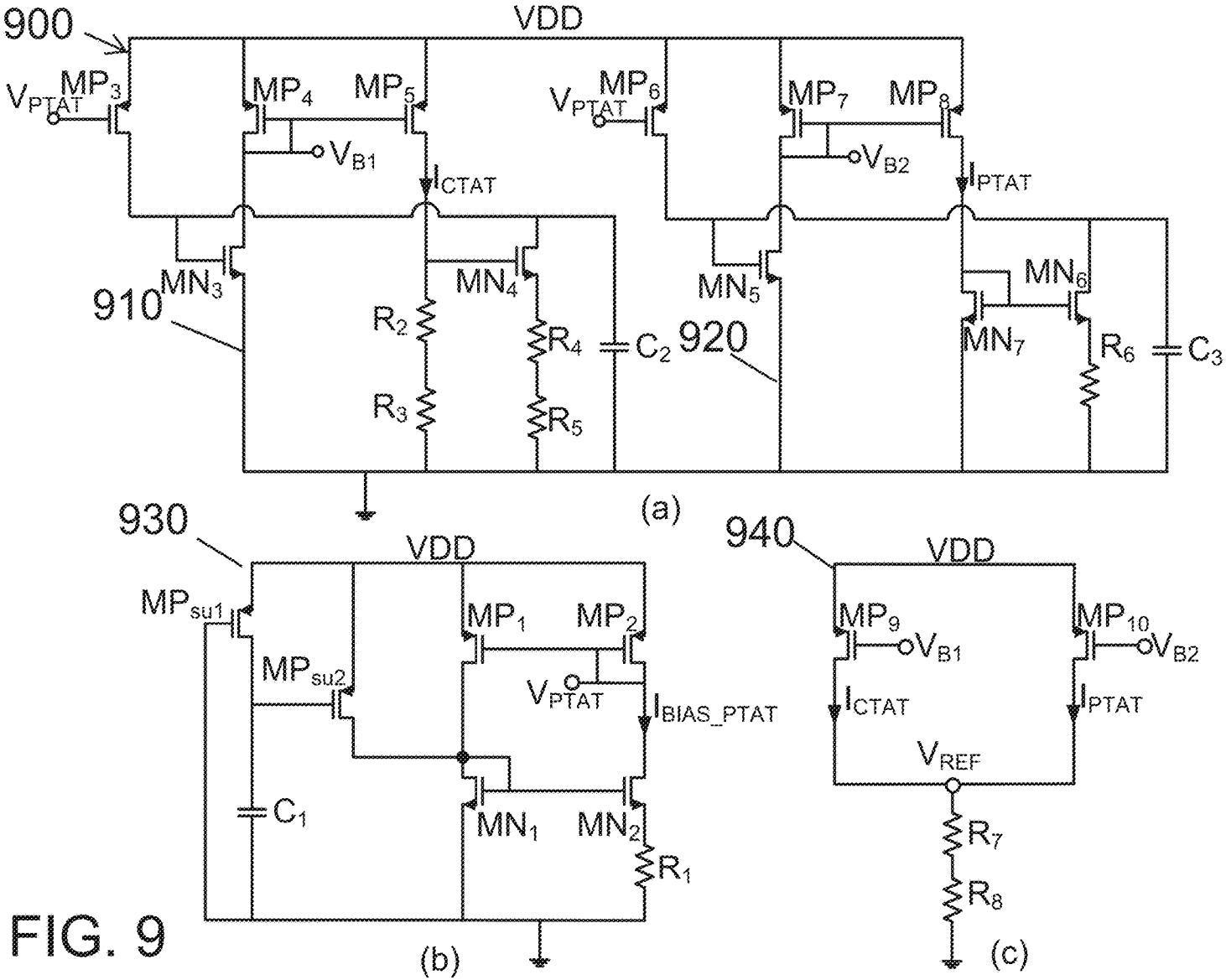
FIG. 9 illustrates an electrical schematic of a voltage reference, in accordance with one embodiment of the present invention.

FIG. 9 illustrates an electrical schematic of a voltage reference 900, in accordance with one embodiment of the present invention.

The voltage reference 900 may include a CTAT feedback loop 910, a PTAT feedback loop 920, a PTAT current bias circuit 930 and an output summing-compensating circuit 940.

The proposed design is illustrated in FIG. 9, where FIG. 9(*a*) shows the core reference module, FIG. 9(*b*) shows the start-up circuit ($MP_{su1}$, $MPs_{u2}$ and $C_1$) and PTAT generator and FIG. 9(*c*) shows the reference output stage. The low $V_{TH}$ (threshold voltage) N channel and P-channel transistors, utilized in the design, typically have a threshold voltage of 0.41V and −0.45V respectively.

The design relies on the fact that the high-resistivity poly-silicon resistors (rpolyh), the low-temperature coefficient poly-silicon resistors (rpolyz), and the CMOS sub-threshold N-type device have unique, but complimentary non-linear responses to changes in temperature. These are graphically illustrated in FIG. 10, where the current is plotted as a function of temperature, for a given bias voltage, corresponding to the nominal bias point in the circuit.

By carefully selecting the ratio of the above currents, in conjunction with the output stage resistors, one may get a temperature insensitive voltage at the reference output. More specifically, from FIG. 9, the gate-source voltage of $MN_4$ decreases with temperature, thus decreasing the voltage drop across $R_2$ and $R_3$. This creates a CTAT current across $MP_5$ that is mirrored to $MP_9$. In a similar way, the gate-source voltage of $MN_6$ decreases with temperature, thus decreasing the gate-source voltage of $MN_7$. Although, $V_{TH}$ of $MN_7$ is decreasing as well with temperature, thus the current flowing across the device is increased. Through $MP_8$ this PTAT current is mirrored to $MP_{10}$. A CTAT and a PTAT currents through $MP_9$ and $MP_{10}$ respectively are summed through $R_7$ and $R_8$, giving a curvature corrected reference voltage with high-order non-linear compensation. Capacitors $C_2$ and $C_3$ are utilized to compensate the phase margin of the two loops so as to ensure the circuit's stability.

The output of the circuit design in FIG. 9 may be expressed as:

$$V_{REF} = (I_{CTAT} + I_{PTAT}) \times (R_7 + R_8)$$

$$V_{REF} = \left(\frac{V_{GS_MN4} + V_{R4} + V_{R5}}{R_2 + R_3} + \frac{V_{GS_MN6} + V_{R6}}{r_{o7} + 1/G_{m7}}\right) \times (R_7 + R_8)$$

Despite the fact that all MOS devices are operated in the sub-threshold regime, mismatch may be maintained under control by increasing device area and by utilizing standard matching techniques. However, process variations, do effect performance of the fabricated chips, thus resistors $R_6$ and $R_7$ are designed to be trimmed so as to compensate process variations of the reference voltage. After extensive Monte Carlo process and mismatch simulations, the values of the trimmable resistors were chosen such that a fast binary search algorithm may be utilized during post fabrication trimming.

Figure 10:
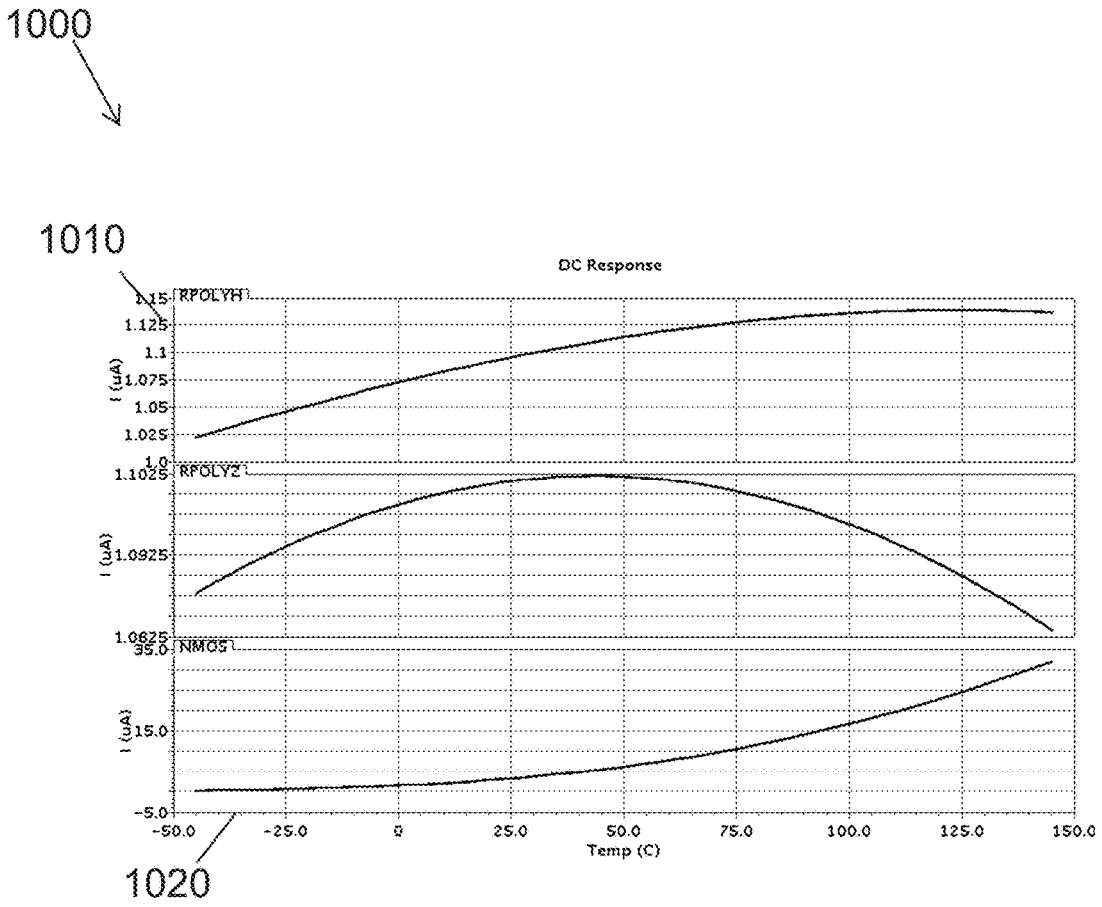
FIG. 10 illustrates a graph of a high resistivity poly-silicon resistor, low temperature coefficient poly-silicon resistor and NMOS sub-threshold transistor, current versus temperature, for a given bias voltage, in accordance with one embodiment of the present invention.

FIG. 10 illustrates a graph 1000 of a high resistivity poly-silicon resistor, low temperature coefficient poly-silicon resistor and NMOS sub-threshold transistor, current versus temperature, for a given bias voltage, in accordance with one embodiment of the present invention.

The graph 1000 may include a current reading 1010 on a y-axis versus temperature readings in Celsius on an x-axis 1020.

TABLE IV

Devices Dimensions of the Circuit Topology

| Component | Parameter |
|---|---|
| $MP_{su1}$ | W = 5 μm, L = 10 μm |
| $MP_{su2}$ | W = 4 μm, L = 12 μm |
| $MP_1$, $MP_2$, $MP_3$, $MP_6$ | W = 25 μm, L = 5 μm |
| $MP_4$, $MP_5$, $MP_7$, $MP_8$ | W = 80 μm, L = 5 μm |
| $MP_9$, $MP_{10}$ | W = 45 μm, L = 5 μm |
| $MN_1$ | W = 35 μm, L = 5 μm |
| $MN_2$ | W = 105 μm, L = 5 μm |
| $MN_3$, $MN_5$ | W = 20 μm, L = 20 μm |
| $MN_4$, $MN_6$ | W = 200 μm, L = 5 μm |
| $MN_7$ | W = 400 μm, L = 5 μm |
| $R_1$ (rpolyh), $R_8$ (rpolyh) | 300 KΩ |
| $R_2$ (rpolyz), $R_3$ (rpolyh) | 345 KΩ |
| $R_4$ (rpolyz), $R_5$ (rpolyh) | 150 KΩ |
| $R_6$ (rpolyh) | 190 KΩ |
| $R_7$ (rpolyz) | 243 KΩ |
| $C_1$ | 2 pF |
| $C_2$ | 20 pF |
| $C_3$ | 5 pF |

The proposed design of FIG. 9 was implemented in 0.35 μm, 3.3 V standard CMOS process utilizing low VTH transistors. All the elements sizes are shown in Table 5 including the resistors types that were utilized in the circuit.

Figure 11:
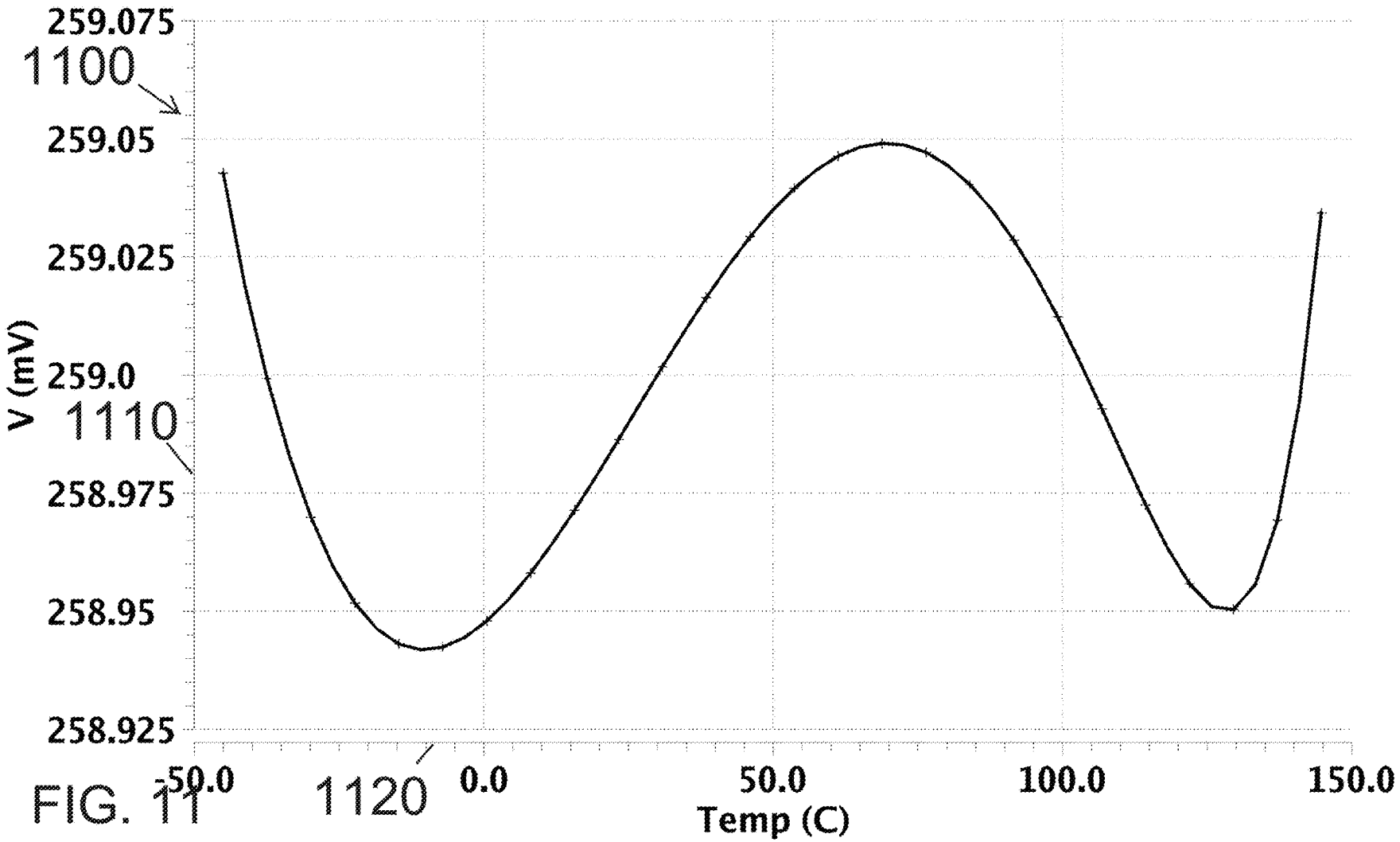
FIG. 11 illustrates a graph of a simulated temperature drift of the reference voltage over a temperature range of 190° C. (−45° C. to 145° C.), in accordance with one embodiment of the present invention.

FIG. 11 illustrates a graph 1100 of a simulated temperature drift of the reference voltage over a temperature range of 190° C. (−45° C. to 145° C.), in accordance with one embodiment of the present invention.

The graph 1100 may include an output voltage reading 1110 on a y-axis versus temperature readings in Celsius on an x-axis 1120. FIG. 11 shows the reference voltage with respect to an extended temperature range of −45° C. to 145° C.

Figure 12:
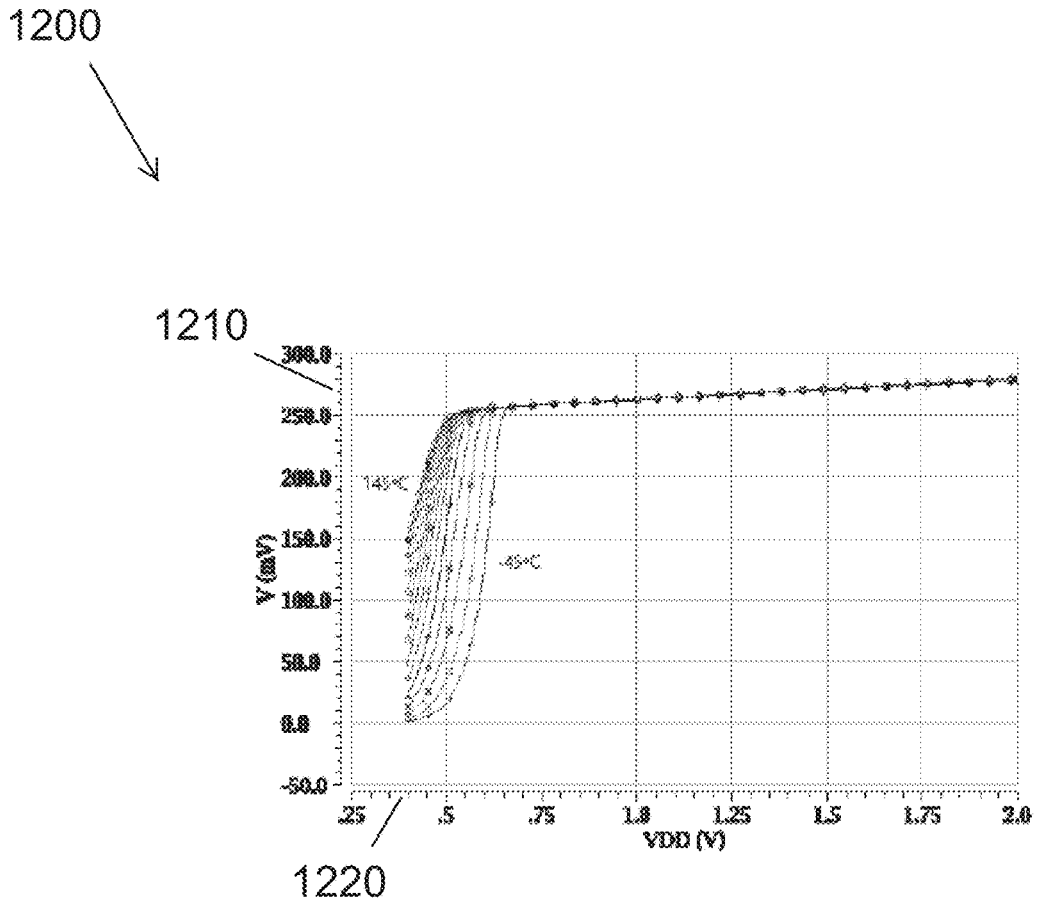
FIG. 12 illustrates a graph of a simulated performance throughout the temperature range (−45° C. to 145° C.) and the supply voltage range (0.4 V to 2 V), in accordance with one embodiment of the present invention.

FIG. 12 illustrates a graph 1200 of a simulated performance throughout the temperature range (−45° C. to 145° C.) and the supply voltage range (0.4 V to 2 V), in accordance with one embodiment of the present invention.

The graph 1200 may include a simulated performance reading 1210 on a y-axis versus a supply voltage reading on an x-axis 1220.

FIG. 12 shows the reference voltage value throughout the temperature range (−45° C. to 145° C.) and the supply voltage range (0.4 V to 2 V).

The proposed circuit had demonstrated that it is possible to design an all-CMOS voltage reference circuit in the sub-threshold regime, whilst maintaining a very competitive performance. By utilizing different kinds of polysilicon resistors and a diode-connected, sub-threshold MOSFET device is possible design a circuit that may easily operate with a supply voltage of 0.75V, yielding a temperature coefficient of 2 ppm/° C. and consuming a mere 2 μW. The proposed topology is suitable especially for applications that have tight limitations on the power budget but still need high performance of temperature drift, such as high accuracy biomedical implants, wearable medical devices and energy harvesting systems. Simulations and Monte-Carlo analysis show that this is an extremely promising design.

While the present invention has been related in terms of the foregoing embodiments, those skilled in the art will recognize that the present invention is not limited to the embodiments described. The present invention may be practiced with modification and alteration within the spirit and scope of the appended claims. Thus, the description is to be regarded as illustrative instead of restrictive on the present invention.

The invention claimed is:

1. A complementary metal oxide semiconductor voltage reference, comprising:

a PTAT biasing circuit including a start-up circuit;

a core module implementing high-order non-linear compensation, the core module biased by the PTAT circuit, the core module including:

a first P-type CMOS transistor coupled to a VDD voltage and having a gate that is driven by a feedback loop originating from a first node, the first P-type CMOS transistor also including a drain terminal;

a first N-type subthreshold CMOS transistor having a gate and a drain coupled to the drain of the first P-type CMOS transistor at the first node and a source coupled to a common voltage;

a source-degenerated second N-type subthreshold CMOS transistor;

a series resistance, including a high-resistivity poly-silicon resistor and a low-temperature coefficient poly-silicon resistor in series, coupled between the first node and the common voltage so as to generate a node voltage at the first node, the node voltage coupled to the gate of the source-degenerated second N-type subthreshold CMOS transistor, the first N-type subthreshold CMOS transistor and the second N-type subthreshold CMOS transistor, the high-resistivity poly-silicon resistor and the low-temperature coefficient poly-silicon resistor having complimentary non-linear responses to changes in temperature;

the second N-type CMOS transistor controlling a gate voltage of a third N-type CMOS transistor via the drain terminal, in conjunction with a PTAT circuit bias; and the third N-type CMOS transistor controlling a gate voltage of the first P-type CMOS transistor via a diode-connected second P-type transistor, in which the second P-type transistor shares a common gate voltage with the first P-type transistor; and an output stage including a P-type CMOS transistor and two different types of polysilicon resistors in series, responsive to the core module and the feedback loop, for supplying reference voltage in order to provide a reference voltage at an output.

2. The complementary metal oxide semiconductor voltage reference according to claim 1, wherein the poly-silicon resistors utilize a trimming methodology to concurrently trim plurality of non-linearities and slope of the reference voltage.

3. The complementary metal oxide semiconductor voltage reference according to claim 2, wherein the complementary metal oxide semiconductor voltage reference compensates for the non-linearities and the slope performed between a transistor $MN_5$ and the poly-silicon resistors.

4. The complementary metal oxide semiconductor voltage reference according to claim 3, wherein the reference voltage is dependent from the poly-silicon resistors and the transistor $MN_5$ to provide a temperature insensitive voltage.

5. The complementary metal oxide semiconductor voltage reference according to claim 1, wherein the poly-silicon resistors are set so as to minimize temperature coefficient.

6. The complementary metal oxide semiconductor voltage reference according to claim 1, wherein the complementary metal oxide semiconductor voltage reference utilizes temperature-dependent threshold voltage and carrier mobility of a MOSFET to generate a plurality of PTAT and complementary to absolute temperature CTAT currents, which are summed in order to provide a first order compensated voltage.

* * * * *